US007534020B2

(12) United States Patent
Moisel

(10) Patent No.: US 7,534,020 B2
(45) Date of Patent: May 19, 2009

(54) LED HEADLIGHT FOR A MOTOR VEHICLE

(75) Inventor: Joerg Moisel, Neu-Ulm (DE)

(73) Assignee: Daimler AG, Stuttgart (DE)

( * ) Notice: Subject to any disclaimer, the term of this patent is extended or adjusted under 35 U.S.C. 154(b) by 14 days.

(21) Appl. No.: 10/539,840

(22) PCT Filed: Dec. 2, 2003

(86) PCT No.: PCT/EP03/13547

§ 371 (c)(1),
(2), (4) Date: Dec. 12, 2005

(87) PCT Pub. No.: WO2004/059207

PCT Pub. Date: Jul. 15, 2004

(65) Prior Publication Data

US 2006/0164853 A1 Jul. 27, 2006

(30) Foreign Application Priority Data

Dec. 20, 2002 (DE) ..... 102 61 183

(51) Int. Cl.
*F21V 21/00* (2006.01)
*F21V 5/00* (2006.01)

(52) U.S. Cl. ..... 362/545; 362/509; 362/522

(58) Field of Classification Search ..... 362/545, 362/543, 544, 509, 520, 522, 475, 507, 227, 362/230, 231, 800
See application file for complete search history.

(56) References Cited

U.S. PATENT DOCUMENTS

| | | | | |
|---|---|---|---|---|
| 4,363,085 | A * | 12/1982 | Demas | 362/467 |
| 4,369,488 | A * | 1/1983 | Brun | 362/521 |
| 4,480,291 | A * | 10/1984 | Dranginis | 362/517 |
| 5,084,804 | A | 1/1992 | Schairer | |
| 6,520,669 | B1 * | 2/2003 | Chen et al. | 362/545 |
| 7,150,552 | B2 * | 12/2006 | Weidel | 362/545 |
| 2001/0019486 | A1 | 9/2001 | Thominet | |
| 2002/0093820 | A1 * | 7/2002 | Pederson | 362/241 |
| 2004/0252501 | A1 * | 12/2004 | Moriyama et al. | 362/238 |

FOREIGN PATENT DOCUMENTS

| | | | |
|---|---|---|---|
| DE | 38 35 942 | A1 | 4/1990 |
| DE | 100 09 782 | A1 | 9/2001 |
| EP | 1 270 325 | A2 | 1/2003 |
| WO | WO 01/01037 | A1 | 1/2001 |

* cited by examiner

*Primary Examiner*—Bao Q Truong
(74) *Attorney, Agent, or Firm*—Patent Central LLC; Stephan A. Pendorf

(57) ABSTRACT

A vehicle headlight, having multiple LEDs provided on a carrier and organized into a group arrangement having an asymmetric design arrived at by starting with an overall symmetric design and providing therein at least one area with non-functional or missing LEDs; and at least one optical element functioning as a common collection lens, wherein the vertical angle of beam spread $\phi$ is less than 5° and the horizontal angle of beam spread $\phi$ is in the range of less than 20° relative to the central optical axis of the optical element.

19 Claims, 5 Drawing Sheets

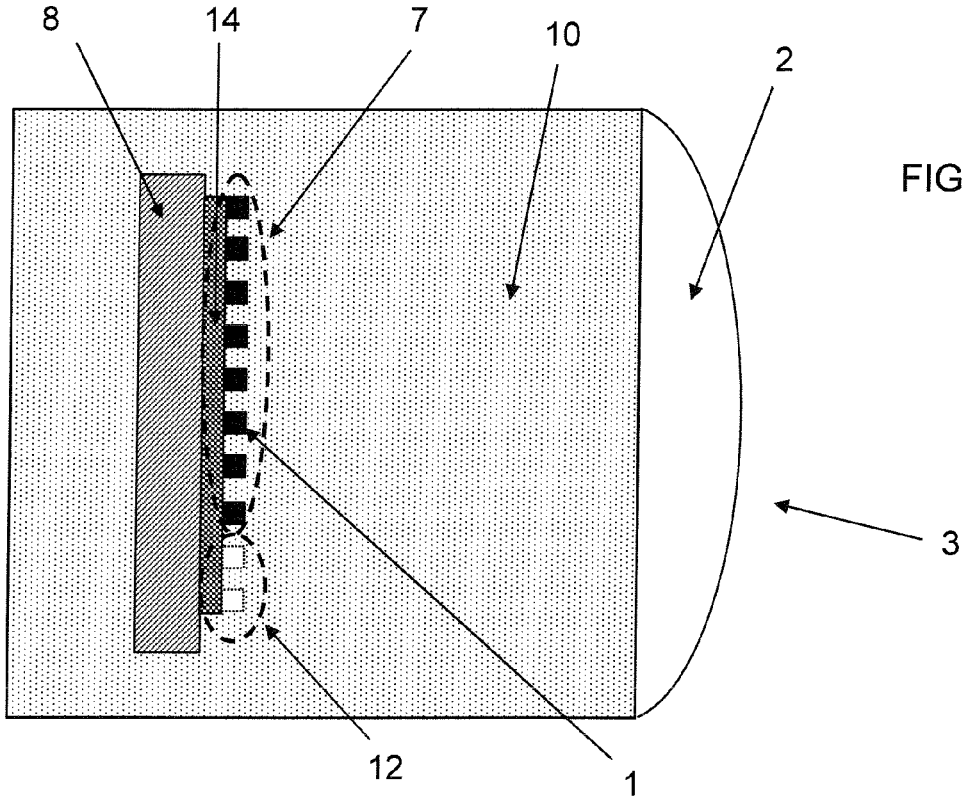
FIG. 4
FIG. 5A
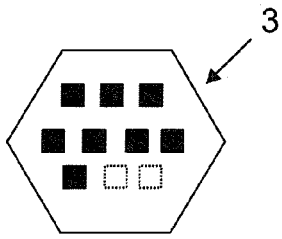
FIG. 5B
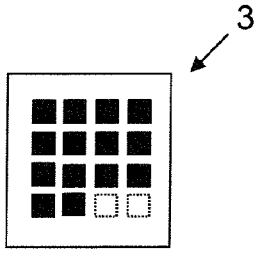
FIG. 6A
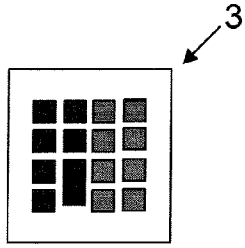
FIG. 6B
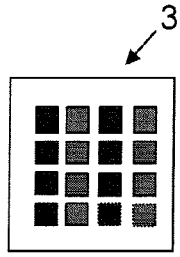

LED HEADLIGHT FOR A MOTOR VEHICLE

CROSS REFERENCE TO RELATED APPLICATION

This application is a national stage of PCT/EP2003/013547 filed Dec. 2, 2003 and based upon DE 102 61 183.1 filed Dec. 20, 2002 under the International Convention.

BACKGROUND OF THE INVENTION

1. Field of the Invention

The invention concerns a LED vehicle headlight with multiple light emitting diodes (LEDs) assembled into an array, which are provided upon a carrier and which are provided with at least one optical element for beam forming.

2. Related Art of the Invention

From utility model DE 201 15 804 U1 a bicycle front headlight is known, which includes at least ten white light emitting LEDs, each of which being associated with a spherical lens, cast upon a carrier and with a common protective lens for protection of the LEDs assembled into one array. This protective lens can have mound-shaped rises, which have the effect of providing each individual LED with its own lens, and acts as auxiliary lens for bundling the light beams in a certain direction. The described headlight does not have a sufficient light intensity.

From European Patent Application EP 1 091 167 A2 a signal transmitter with rows of LEDs is known, wherein each of the individual LEDs arranged in a row has its own spherical lens. The individual rows are associated with condensers in the Fresnell manner of construction and these condensers are for their part associated with a common emitter disk. By the arrangement of the rows and the condensers, a homogeneous, even, symmetric emission is ensured. The described signal transmitter exhibits an insufficient light intensity for use as a vehicle headlight.

Electronic components are available from the company Roithner Lasertechnik under the trade reference number LED870-66-60, which exhibit in a housing an array of 5×12 infrared-LED-chips, which can be collectively driven. The housing is a TO-66-housing with AIN-ceramics.

SUMMARY OF THE INVENTION

The invention is concerned with the task of providing a vehicle headlight, which provides a vehicle-specific asymmetric distribution of headlight light with sufficient light intensity.

This task is solved by a vehicle headlight with multiple LEDs provided on a carrier and organized into array, at least one optical element functioning as common collection lens, and a housing, wherein this overall array has an asymmetric design arrived at by starting with an overall symmetric design and providing therein at least one area with non-functional or missing LEDs, wherein the LEDs are LED-chips, and wherein the array and optical element are assembled into a LED-module.

Advantageous further developments of the invention are the subject of the dependent claims.

The inventive vehicle headlight includes an asymmetric arranged array, which contains multiple LED-chips and therewith, at the same light intensity, is substantially more compact than the arrays in the known vehicle headlights with LEDs, which contain an individual light emitting diode in a 5 mm plastic housing, which simultaneously acts as a lens. Beyond this, by the non-asymmetric design of the array, the desired non-symmetric, that is asymmetric, design of the light cone of the vehicle headlight is achieved. This asymmetric array is associated with a common lens, which collects as a common collecting lens the light of the LED-chips of the array and is used for illumination of the environment of the vehicle. Therein the asymmetrical array with the LED-chips and the associated lens are integrated into a LED-module. As such, the LED-module can be very easily installed in a vehicle and be supplied with the necessary energy.

The inventive LED headlight exhibits, due to its construction, an exceptionally long life, which in particular requires no distinct temperature stabilization or cooling, and provides a well defined asymmetric and high intensity vehicle headlight. In particular, this asymmetric light distribution is characterized by a particularly pronounced light/darkness boundary.

It has been found particularly useful to arrange the LED-chips in the vicinity of the focal plane of the lens. Thereby it is ensured that the light of each individual LED-chip, by the collection lens working as optical lens, is projected focused to infinity or near to infinity. Thereby it is achieved to design and construct the vehicle headlight very efficiently and reliably. A too-diffuse light distribution of the headlight can be avoided thereby.

It has been found particularly advantageous to select a vertical angle of beam spread $\phi$ of the vehicle headlight. In order to accomplish this, the lens and the dimension of the array is so selected, that the vertical emission angle $\phi$ is less than 5°. This is achieved thereby, that the relative vertical deflection X of the array from the optical axis and the focal width f of the lens is so selected that it satisfies the equation:

$$\phi=\arctan(x/f)<5°$$

In corresponding manner it has been found useful to select the horizontal deflection or excursion of the array to be such that the horizontal emission angle $\phi$ is in the vicinity of less than 20°. By this selected design, in combination with the asymmetric array, it is ensured that a good, characteristic asymmetric distribution of the vehicle light is provided with sufficient beam width.

A particularly robust and non-obtrusive (little noticeable) LED-module, and therewith a corresponding LED vehicle headlight, is accomplished thereby, that the intermediate space between array and lens is cast-in or effused or filled in with an optically transparent material. Materials which have been found to be particularly suitable include polycarbonate (PC), epoxy resin or polymethylmethacrylate (PMMA). By this casting, a mechanically and electrically as well as optically very robust module is produced. The optically transparent material is therein so selected that, together with the provided lens, it provides the desired characteristics of a common collection lens. Thereby the lens can be formed of the same or another appropriate optical material.

Beyond this it has been found particularly advantageous to hard wire the plurality of LEDs or, as the case may be, LED-chips provided in the array with each other and thereby to reduce the number of electrical contacts for the LED-module, and in particular for energy saving. In certain cases two common contacts suffice for all voltage distribution. Through this hard wiring it is achieved to keep the construction of the vehicle headlight very simple and robust. In particular it is achieved, to be able to transform the critical aspects for the production of the headlight with respect to dimensional stability or, as the case may be, assembly, into an automated optimized production process for a LED-module, so that for the installation of the LED-module in the vehicle headlight or, as the case may be, in the vehicle no advanced requirements are placed on the skills of the production workers. This leads to an elevation in the quality of the vehicle headlight. This even more, when the LED-module is in the form of a compact LED-module cast-in with optically transparent material. Thereby the mechanical or other influences on the interconnected arrangement of the individual components of the LED-module are substantially precluded.

By a preferred arrangement of the LED-chips into a hexagon, quadratic or rectangular grid a very space saving array is provided, which is characterized by a very small interstitial space between the light active elements and which, for a predetermined surface area for the array, exhibits a very high density of active LED-chip surfaces, so that with predetermined surface area a high light output and therewith high light intensity of the LED headlight can be achieved. This makes possible a compact construction of the inventive headlight.

Preferably the asymmetric array is formed thereby, that beginning with a symmetric, regular array, for example a 20×30 array, one or more regions of the symmetric array, for example one corner of the array, need not be provided with LED-chips. Thus there results an asymmetric array in the shape of a square with cut off corners. By this asymmetric design of the array a desired light distribution of the vehicle light is predetermined since in the end the asymmetric array is projected with the inventive headlight by the targeted or selected arrangement in the vicinity of the focal plane of the lens upon the environment of the vehicle. Therewith in the described case a light distribution is realized, which exhibits a characteristic, which corresponds to a square with cut off corners. By this simple realization of the light emitting array of LED-chips in the shape of a specific asymmetric array corresponding to the desired light distribution of the vehicle headlight, it is achieved to dispense with complex, supplemental, beam forming means, such as supplemental shields, expensive range selective lenses, and the like. Therewith a very simple and effective construction of the LED headlight is provided.

Besides not providing LED-chips in an originally symmetric planar array it is also possible to realize this array symmetrically, however not to operatively enable one or more regions of the symmetrical array. This can be accomplished by an appropriate circuitry, for example by not wiring. Here it is also possible to switch certain areas selectively on and off, in order to realize various desired light distributions.

One inventive vehicle headlight with LED-chips, which is exclusively infrared emitting, that is, emitting electromagnetic rays in a wavelength of greater than 780 mm, has been found particularly suited therefore, since this infrared-LED-chip is particularly powerful and therewith particularly suited for this type of vehicle headlight, in particular for employment in the framework of an infrared night vision device. The therefore relevant asymmetric array shows as a rule a very small number of infrared-LED-chips so that it is very economical and simple to produce.

Besides this, headlights with LED-chips which are not emissive in the infrared but rather in the visible light spectrum have demonstrated themselves to be useful in the inventive headlight. Since this vehicle headlight emits not only infrared radiation but rather also visible light, it is ensured that other traffic participants, which are illuminated by the infrared beam so that a danger in particular to their eyes could occur, are simultaneously blinded by the visible light, so that the damage to the eyes by the infrared radiation is avoided by holding before the eyes shielding objects or by the simple turning away of the head. Thereby a very safe inventive headlight is provided.

With the development of very powerful LED-chips in the visible range, in particular so-called bright light LEDs, it has become possible not only to produce not only weak emitting lights, such as back up lights, brake lights or the like, but rather also strong light headlights for high beams or for low beams. Precisely this headlight, in particular in the use as low beam headlight, shows the necessity to undertake precautions in order to achieve sufficiently the desired requirements with regard to an asymmetric light distribution, which the present asymmetric light distribution enables. By the inventive selection of the asymmetric design of the array of LED-chips the desired asymmetric light distribution is provided in particularly simple, effective and economical manner.

Two embodiments of the asymmetric array have been found to be particularly advantageous. The one shows an essentially regular, in particular alternating arrangement of LED-chips, which emit only infrared radiation, as well as LED-chips, which emit only visible light. By this alternating arrangement it is ensured that a substantially even distribution of the IR-emission and the visible light—that is, according to DIN 5031, electromagnetic radiation with a wavelength between 380 nm and 780 nm—is provided by the design of asymmetric array determined light cone of the vehicle headlight. Thereby it has been found particularly advantageous to operate the infrared LED-chips and the LED-chips for visible light alternatively or even simultaneously, which can be realized by the corresponding circuitry or, as the case may be, by a selective energizing of the corresponding LED-chips.

According to the other design, the asymmetric design is provided with regions which are separated from each other and which respectively are provided with either LED-chips for infrared radiation or, as the case may be, LED-chips for visible light. By these regions separated from each other a differentiated beam emission of the visible light and of the infrared radiation of the vehicle headlight is created. For example, by this design the right region of the headlight cone can be illuminated with visible light while the left region of the headlight cone can be illuminated with infrared radiation. It is also possible to produce vertical or other differentiations. By this design of the distribution of the LED-chips a very diverse beam emission characteristic of the inventive headlight can be realized. In particular a long range infrared headlight and simultaneously a near range visible light illuminating headlight can be produced. This type of headlight has been found particularly useful, since it is particularly suited for a night vision function and it substantially improves the vision under difficult conditions, such as for example at night. Thereby the number of traffic accidents can be significantly reduced.

Besides this, vehicle headlights have been found particularly useful, which include not only a single inventive LED-module, but rather multiple modules of this type, which preferably are close together and are provided either in the same plane or preferably along the course of a curved vehicle outer surface. The multiple LED-modules are so arranged, that they emit, essentially parallel to each other, the best infrared beam or, as the case may be, visible beam, and the respective light cones alternatingly overlap with the module parallel offset. Since the LED-module preferably exhibits the same light distribution due to the corresponding design of the asymmetric array, there is by this arrangement of the multiple LED-modules an equalizing or evening out or leveling out of light intensity deviations in the light distribution of a LED-module. This leads to a very pleasant, consistent light distribution or, as the case may be, beam distribution. This headlight also has demonstrated itself, by the use of the multiple or, as the case may be, multiplicative use of inventive LED-modules, with regard to an even light distribution, not to be affected by loss of individual LED-chips in individual arrays. In accordance with the invention there is accomplished, besides the overlapping of the light distribution of the various LED-modules, nevertheless a clear, distinct light/darkness boundary. This leads to a very pleasant illumination of the environment of the vehicle with a corresponding inventive vehicle headlight.

By the preferred design of the LED-module as adjacent modules it is ensured that the sideways displacement is kept as small as possible and thereby the light production or yield per the surface area, upon which the LED-modules are provided, is maximized. This leads to a very light, bright vehicle headlight, via which a particular standard of vehicle safety can be achieved. Thereby also a simple parallel orientation of the LED-modules is enabled. By the simple alignment or aiming by the contacting or connecting to each other, a simple assembly process is provided, which requires no extensive machining or alignment process. This leads to a very cost effective manufacturability, without suffering any loss in manufacturing quality. The manufacturing steps which are quality determinative particularly for the production of the headlight are already realized by the manufacturing or, as the case may be, pre-production of the LED-module. Thereby particular production processes and assembly lines with a quality elevating degree of automation are provided. In comparison to which, the installation of the pre-manufactured LED-modules in a vehicle in a production line is enabled without particular complexity.

Besides this, it has been found particularly advantageous to provide the LED-modules in a plane, in particular on a common carrier, which has been found to be the simplest and, from the manufacturing point, most economical. Besides this it has also been found useful to provide the LED modules not in a plane, but rather preferably corresponding to the course of a curved vehicle surface, such as for example the front of a vehicle. Thereby it must be ensured, that the LED-module emits visible light or, as the case may be, the infrared emissions, essentially parallel to each other. A mutual or reciprocal or alternating displacement along the direction of widening of the IR-beam or, as the case may be, the visible light leads in accordance with the invention not to a substantial reduction of the area illuminated by the headlight. Therewith it is clear, that the headlight with the multiple LED-modules, which in particular exhibit the same asymmetric array, and in particular cast in design optimized manner, be provided upon the outer surface of the vehicle or located in this or other location. The headlight follows or obeys the aesthetic design desired by the designer of the vehicle, and not the reverse. It is not necessary that the known headlight with the flat, planar, front disk must be integrated in the outer curved upper surface of the vehicle, but rather, the inventive headlight can without substantial difficulties be integrated in the design of the curved vehicle surface. This all the more since the inventive headlights exhibit a substantially smaller component depth, in the range of typically less than 10 cm, than the other halogen or xenon headlights, with a component installation depth of greater than 40 cm.

Therein it has been found particularly advantageous to join the LED-modules releasably with each other. Thereby it is possible to remove individual modules from the vehicle headlight and to replace these with other modules. This is in particular relevant for the case of repair or also with respect to a changing legal requirement with respect to the design of the asymmetric light distribution of the vehicle headlight. Also, national specific adaptations, for example left driving compared to right driving, can in this manner be particularly simply adapted to. Therewith a very flexible vehicle headlight is provided.

Further, it has been found particularly advantageous to provide multiple LED-modules on a common carrier, which enables a common manipulation or, as the case may be, in parts to the LED-modules a common stability, however also provides the possibility to conjointly operate or, as the case may be, control a common energy supply. By this design of the vehicle headlight a vehicle headlight is provided, which is particularly simple to produce, since the LED-module can for example be introduced form-fittingly in pre-manufactured recesses on the carrier and therewith be provided there-upon. An error prone application of the LED-module upon a common carrier is in this case substantially precluded, which leads to a qualitatively very high value vehicle headlight.

Therein the carrier for the vehicle headlight can be designed vehicle-specific, in that it allows for various numbers or various arrangements or various circuitry or, as the case may be, control of the LED-modules, which in their outer shape or overall are identical LED-modules. Thereby with the same LED-modules alone or by use of another carrier a large number of various vehicles can be adapted to with regard to the respective requirements. This modular design of the inventive headlight has been found particularly useful.

Besides the possibility, that as the single lens the lens of the respective LED-modules is provided, supplementally to provide an optical element, which works together with multiple LED-modules collectively and is associated therewith and together with the individual lenses of the module cooperates to the extent that in particular the LED-chips are provided in the region of the focal plane predetermined by the optics by this supplemental common lens, it is enabled to reduce the construction depth of the vehicle headlight and thereby to provide a greater employability of the vehicle headlight.

Besides the use of the simple cost effective light emitting diodes, it has been found particularly advantageous to use laser diodes, in particular so called VICSEL, that is, laser diodes with associated vertical resonators, since they emit a very wavelength-selective light. Beyond this, these VICSELs can, from the manufacturing perspective, be produced very simply as an array, in particular as an asymmetric array, which leads to a cost effective and reliable headlight.

BRIEF DESCRIPTION OF THE DRAWINGS

In the following the invention will be described in greater detail on the basis of an exemplary embodiment.

FIG. 4 is a schematic side view of the LED-module

FIG. 5A is a schematic view front view of a LED-module arranged in a hexagonal pattern.

FIG. 5B is a schematic view front view of a LED-module arranged in a quadratic or square pattern.

FIG. 6A is a schematic view front view of a LED-module wherein the IR and the visible light emitting LEDs are arranged alternating in the asymmetric group arrangement FIG. 6B is a schematic view front view of a LED-module wherein one part is provided with only IR emitting and another part with visible light emitting LEDs.

DETAILED DESCRIPTION OF THE INVENTION

Figure 1:
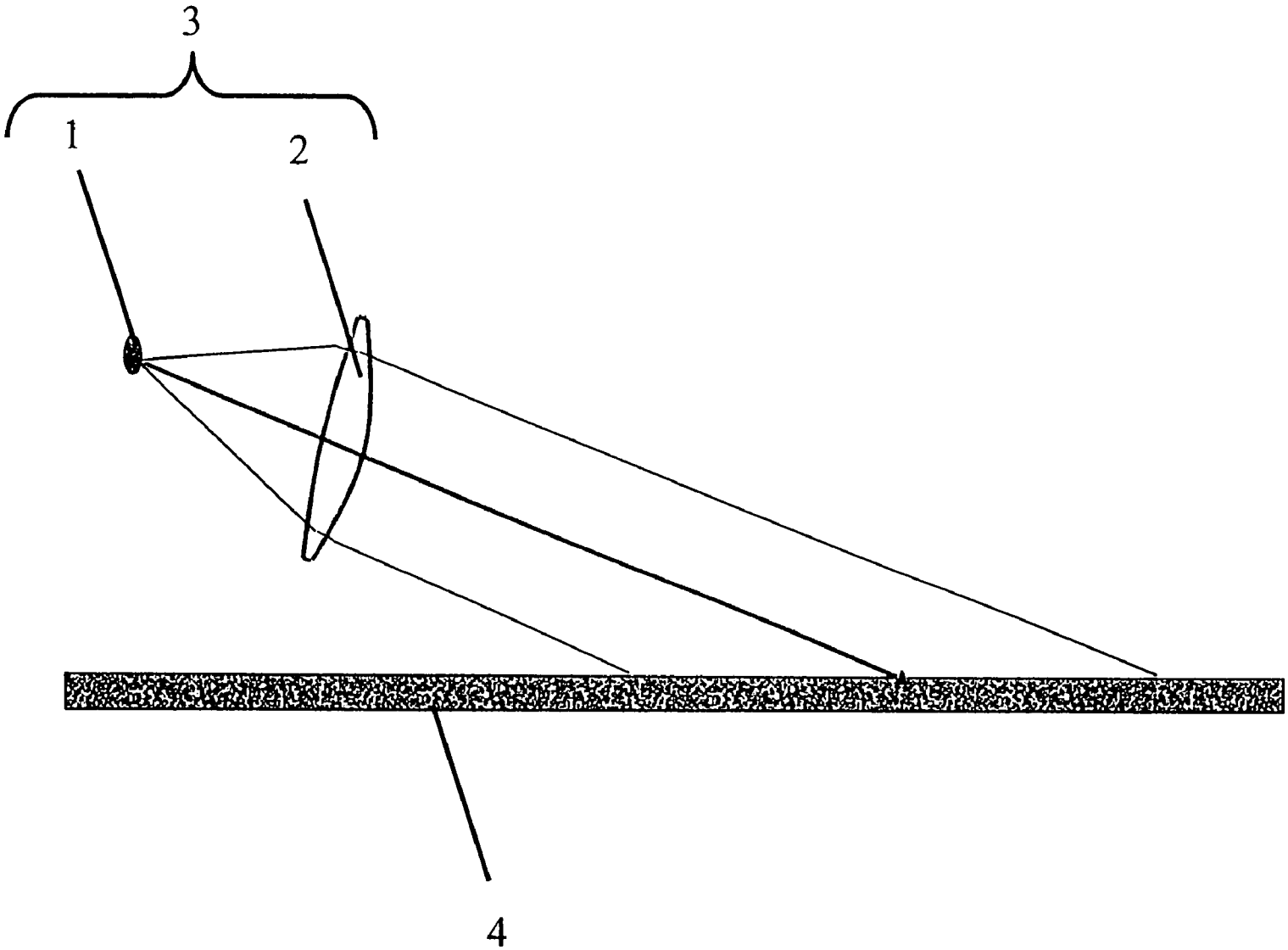
FIG. 1 shows the beam pattern of a LED-chip of a LED-module of an exemplary vehicle headlight.

In FIG. 1 the beam pattern of a LED-chip 1 of the asymmetric array of LED-chips of the inventive vehicle headlight is shown. A LED-chip 1 is spaced apart from the lens 2 acting as collection lens of the LED-module 3, such that it lies in the focal plane of the lens 2. Thereby it is ensured, that the infrared emission transmitted from the LED-chip 1 is emitted bundled through the lens 2. The bundling brings about that the emitted infrared radiation of the LED-chip 1 is projected to be infinite. This means, that the bundled infrared radiation shows a parallel beam course. Therewith the quasi point-shaped infrared radiation source is shaped to a flat point. This flat or planar point impinges upon the surface of the ground 4 and obtains there an oval shape. The oval plane exhibits an essentially even light distribution.

Figure 2:
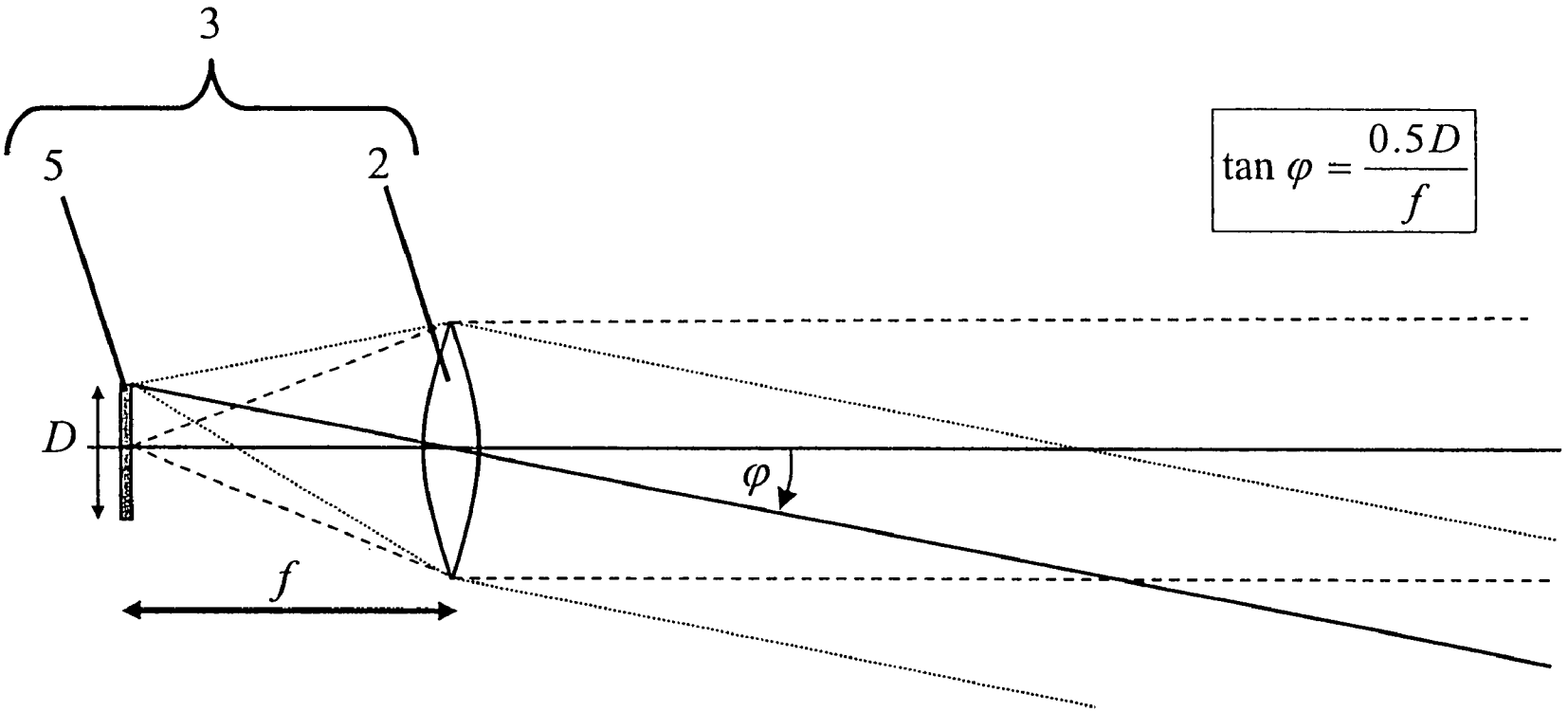
FIG. 2 shows in a longitudinal section an exemplary beam pattern of an exemplary inventive vehicle headlight.

In FIG. 2 the illumination characteristic of the LED-module 3 is shown schematically. The array 5 is comprised of a number of individual LED-chips, and has a planar distribution. The array 5 is provided in the region of the focal plane of the lens 2 so that each individual point of the array 5, which is formed by one LED-chip, as shown in FIG. 1, is designed to the infinite. Thereby a planar array 5 is projected through the lens 2 in the region shown in the figure to the right of the lens 2. The projection leads to an enlarged depiction or projection of the array 5. This enlargement is directed primarily along radiation angle $\phi$. This results from the equation $$\phi=\arctan(0.5*d/f).$$

Therein d represents the length of the array 5 and d/2 represents the length of the array 5 projecting beyond the optical axis. The focal width of the lens 2 acting as collection lens is indicated with f. The angle of radiated beam $\phi$ is therewith essentially determined by the dimensions of the design of the asymmetric array 5. Beyond this, the focal length essentially has an influence upon the angle of radiated beam $\phi$.

A preferred embodiment of an asymmetric array 5 with a width of 8.7 mm and a length of 36.4 mm leads to a spacing of the array 5 from the center axis of the lens of 50 mm at corresponding focal width f of the lens 2 to an angle of radiated beam $\phi$ in the horizontal direction to an approximately 20° and a vertical angle of radiated beam $\phi$ of approximately 5°. These angles of radiated beam $\phi$ they can be very advantageous. The described array exhibits a surface area of approximately 300 $mm^2$. The difference between this surface area and a completely symmetrical square designed array is based thereupon, that an edge area of the symmetric square array is not provided with LED-chips and thereby does not contribute to the light emission or, as the case may be, light generation or infrared emission generation. If one assumes that a LED-chip has a surface of approximately 1 $mm^2$, this leads to an array, which exhibits approximately 300 of this type of LED-chip. These 300 LED-chips form respectively their light cone through the lens 2 corresponding to the embodiment of FIG. 1 focused to infinite.

Another preferred arrangement of array 5 and lens 2, which constitute in LED-module, exhibits a horizontal emission angle $\phi$ of 8° and a vertical emission angle $\phi$ of 2° at a focal width f of 50 mm. This leads to an array surface of 14 mm by 3.5 mm and therewith to an array surface area of approximately 45 $mm^2$, wherein the difference to 49 $mm^2$ is provided by the cutting out of the area without LED-chips. This LED-module exhibits an exceptional high-beam characteristic, that is, a headlight for an illumination of a distant area, in comparison to which, in the above mentioned LED-module, the corresponding headlight with an angle of beam spread of 5° or, as the case may be, 20° exhibits an exceptional low-beam characteristic.

Figure 3:
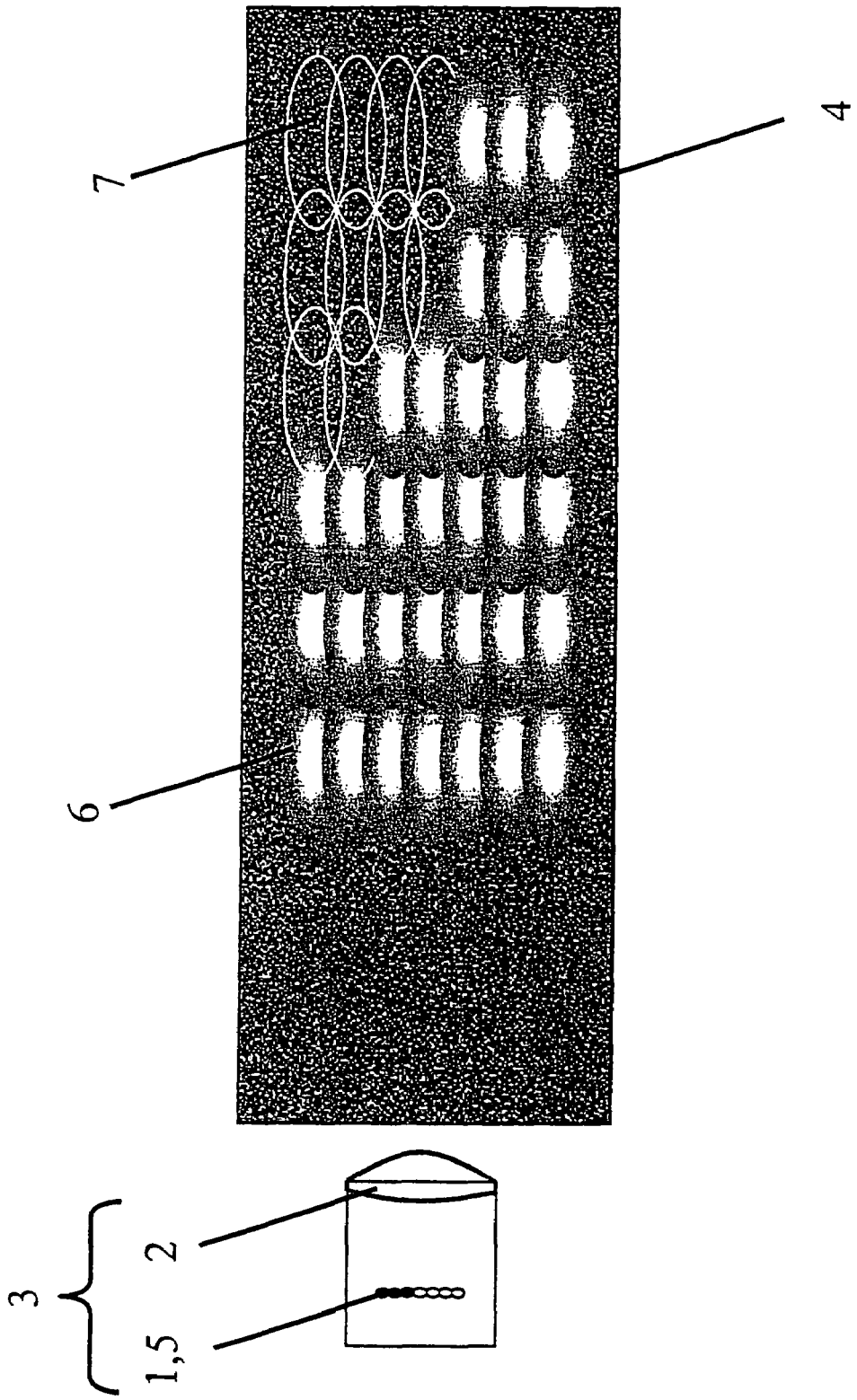
FIG. 3 shows in a schematic top view the asymmetric light distribution of an exemplary vehicle headlight.

In FIG. 3 there is schematically shown the projection of an asymmetric array 5 of LED-chip 1 upon the street 4 from above. The individual LED-chips 1 of the asymmetric array 5 are projected through the lens 2 as an oval 6 upon the street 4. The close adjacent LED-chips 1 are, according to their arrangement, designed as adjacent oval light regions 6 upon the street 4. Thereby the result is cohesive, overlapping oval light regions 6 which combine to a planar asymmetric total light distribution. The not illuminated oval light regions 7 correspond to the areas which would otherwise complete the asymmetric array 5 into a symmetric array, and which are not provided with LED-chips. Therein the asymmetric design of the illuminated surface corresponds to the design of the asymmetric array 5. By the suitable selection of the array 5 and the lens 2 as well as the alternating arrangement the size of the individual oval light surfaces 6 and, therewith the cohesive illuminated asymmetric surface, is determined. By the inventive design of the LED-module 3 with an asymmetric LED-chip array 5 a very simple and effective asymmetric light guidance for a LED headlight is provided.

In FIG. 4 the LED-module is shown schematically. The asymmetrical array 5 contains a number of individual LED-chips, and has a planar distribution. The asymmetrical array 5 consists of an area 7 containing LEDs and an area 12 not containing LED-chips or containing non-functional LED-chips (The missing or non-functional LED-chips are indicated by the broken line). The area 12 would otherwise complete the asymmetrical array 5 into a symmetrical array, An optically transparent material 10 is cast into the LED-module. The LED-chips 1 are hard wired together and this hard wiring or hard circuit 14 is bonded to the carrier 8.

FIG. 5A shows a LED-module 3 arranged in a hexagonal pattern.

FIG. 5B shows a LED-module 3 arranged in a quadratic or square pattern.

FIG. 6A shows a LED-module 3 wherein the IR and the visible light emitting LEDs are arranged alternating in the asymmetric group arrangement.

FIG. 6B shows a LED-module 3 wherein one part is provided with only IR emitting and another part with visible light emitting LEDs.

Figure 7:
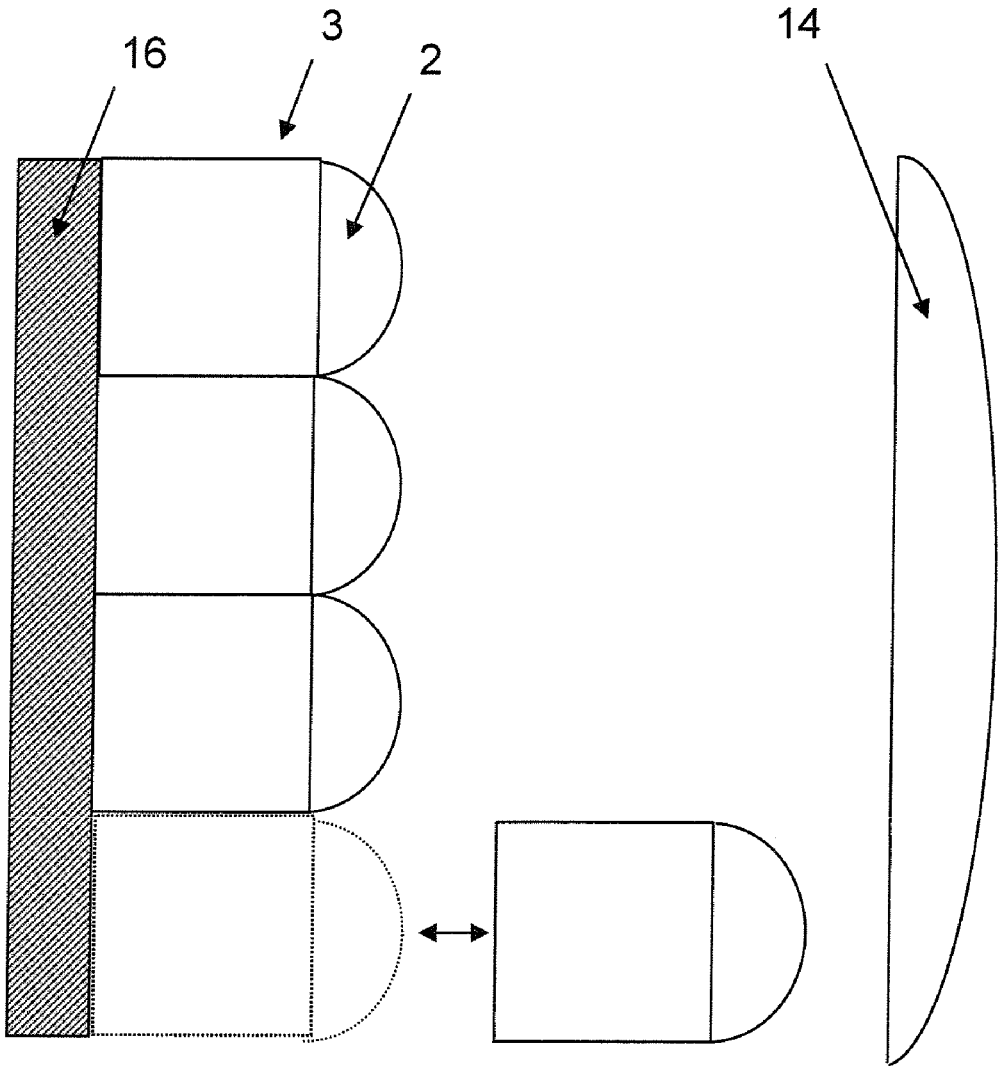
FIG. 7 is a schematic view of various LED-modules 3 arranged on a common carrier.

FIG. 7 shows various LED-modules 3 arranged in one plane, on a common carrier 16 contacting each other. The LED-modules 3 are releasable connected with each other (indicated by one released LED-module). A common supplemental optical element 14 cooperates collectively with the lenses of each LED-module.

The invention claimed is:

1. A vehicle headlight, comprising:

multiple LEDs provided on a carrier and organized into a group arrangement, and at least one optical element functioning as a common collection lens, wherein the group arrangement has an asymmetric design arrived at by starting with an overall symmetric design and providing therein at least one area with non-functional or missing LEDs, wherein the LEDs are LED-chips disposed in a region of a focal plane of the common collection lens, wherein the group arrangement and optical element are assembled into a LED-module, and wherein the vertical beam spread ϕ of the headlight is less than 5° and the horizontal beam spread ϕ of the vehicle headlight lies in the range of less than 20°, said horizontal and vertical being relative to the earth.

2. The vehicle headlight according to claim 1, wherein the group arrangement and optical element are assembled into an LED-module; and further comprising an optically transparent material cast into the LED-module.

3. The vehicle headlight according to claim 1, wherein the LEDs are LED-chips, the LED-chips are hard wired together and this hard wiring or hard circuit is bonded to the carrier.

4. The vehicle headlight according to claim 1, wherein LED-chips are arranged into an LED-module in a hexagonal, quadratic or square pattern.

5. The vehicle headlight according to claim 1, wherein the asymmetric group arrangement exhibits a design which corresponds to an asymmetric distribution of the beam.

6. The vehicle headlight according to claim 1, wherein the LEDs emits exclusively IR radiation, or IR radiation with visible light, or exclusively visible light.

7. The vehicle headlight according to claim 1, wherein a part of the group arrangement is provided with only IR emitting and another part with visible light emitting LEDs.

8. The vehicle headlight according to claim 7, wherein the IR and the visible light emitting LEDs are arranged in the asymmetric group arrangement.

9. The vehicle headlight according to claim 7, wherein the only IP emitting LEDs and the visible light emitting LEDs are separated in an asymmetric group arrangement.

10. The vehicle headlight according to claim 1, wherein the group arrangement and optical element are assembled into a LED-module; and further comprising multiple LED-modules, which are arranged in one plane.

11. The vehicle headlight according to claim 10, wherein the LED-modules contact each other.

12. The vehicle headlight according to claim 11, wherein the LED-modules are releasably connected with each other.

13. The vehicle headlight according to claim 10, wherein the LED-modules are provided upon a common carrier which is shaped or has circuitry which is vehicle-specific.

14. The vehicle headlight according to claim 1, wherein the vehicle has a curved surface, and wherein multiple of the LED-modules are provided arranged as to correspond to the curvature of a curved vehicle surface.

15. The vehicle headlight according to claim 14, wherein the multiple LED-modules contact each other.

16. The vehicle headlight according to claim 15, wherein the multiple LED-modules are releasably connected with each other.

17. The vehicle headlight according to claim 14, wherein the multiple LED-modules are provided upon a common carrier which is shaped or has circuitry which is vehicle-specific.

18. The vehicle headlight according to claim 1, wherein the multiple LED-modules are associated with a common supplemental optical element, which cooperates collectively with the lenses of each module.

19. The vehicle headlight according to claim 1, wherein the LEDs are laser diodes or laser diodes with vertical resonators.

* * * * *